US007322801B2

(12) United States Patent
Li et al.

(10) Patent No.: US 7,322,801 B2
(45) Date of Patent: Jan. 29, 2008

(54) COMPACT LINEAR AIR PUMP AND VALVE PACKAGE

(75) Inventors: Wenjun Li, Monroe, LA (US); Steven D. Heidenreich, Monroe, LA (US); Randall M. Blindauer, Sheboygan, WI (US)

(73) Assignee: Thomas Industries Inc., Sheboygan, WI (US)

( * ) Notice: Subject to any disclaimer, the term of this patent is extended or adjusted under 35 U.S.C. 154(b) by 754 days.

(21) Appl. No.: 10/649,843

(22) Filed: Aug. 26, 2003

(65) Prior Publication Data

US 2005/0047923 A1 Mar. 3, 2005

(51) Int. Cl.
*F04B 35/04* (2006.01)
*F04B 39/06* (2006.01)
*F04B 39/08* (2006.01)

(52) U.S. Cl. ..... 417/366; 417/363; 417/413.1; 417/442; 417/505

(58) Field of Classification Search ..... 417/118, 417/234, 900, 366, 413.1, 505, 442, 363
See application file for complete search history.

(56) References Cited

U.S. PATENT DOCUMENTS 3,208,643 A * 9/1965 Phillips ..... 222/626
3,544,010 A * 12/1970 Jurdye ..... 239/168
4,859,152 A * 8/1989 Kimura et al. ..... 417/63
5,011,379 A * 4/1991 Hashimoto ..... 417/360
5,074,758 A * 12/1991 McIntyre ..... 417/138
5,573,148 A * 11/1996 Poole et al. ..... 222/611.1
5,606,756 A * 3/1997 Price ..... 5/713
6,210,122 B1 * 4/2001 Brøndbo ..... 417/55
6,390,790 B1 * 5/2002 Robertson et al. ..... 417/413.1
2003/0079796 A1 * 5/2003 Raposo et al. ..... 141/5

* cited by examiner

*Primary Examiner*—Charles G. Freay
(74) *Attorney, Agent, or Firm*—James B. Conte; Barnes & Thornburg, LLP

(57) ABSTRACT

A compact air pump and valve package includes pump and valve assemblies integral with a pressure housing defining inlet ports and a plurality of fittings for connecting air lines to an interior of the pressure housing. The linear diaphragm pump assembly has a permanent magnetic shuttle mounting two diaphragms reciprocated by an electromagnet. The valve assembly has a plurality of solenoid valves disposed within the pressure housing, each solenoid valve being operable to control flow into or out of the pressure housing through an associated one of the plurality of fittings. Thus, no tubes or hoses are required to transfer air from the pump assembly to the valves. The housing has special mounts to isolate vibration arising from movement of the shuttle.

18 Claims, 8 Drawing Sheets

COMPACT LINEAR AIR PUMP AND VALVE PACKAGE

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

1. Technical Field

The present invention relates to pumps and in particular to linear diaphragm air pumps.

2. Description of the Related Art

Air compressors and pumps are well known. Some are large reciprocating piston and cylinder pumps for high flow volume commercial or industrial applications and others are compact units for lesser flow home applications. One example of the latter is inflating a bladder membrane, such as an air mattress for an air bed. Pumps for inflating and deflating air mattresses need to provide rapid pressurization while being both compact and quiet.

U.S. Pat. No. 5,606,756 discloses an example of a pump for an air mattress application. This pump has a motor rotated shaft mounting two canted flanges at opposite ends with push and pull sets of diaphragm pistons causing air flow. The pump is contained in a single, compact housing which is partitioned into essentially five compartments, including a motor chamber, two valve chambers (one on each side of the motor chamber), an end chamber and a solenoid chamber. The motor chamber is open to ambient pressure and the valve chambers become pressurized by movement of the diaphragms. Valves control flow from the valve chambers to the solenoid chamber, with flow from one valve chamber passing first through the end chamber and then through an internal conduit passing through the motor and other valve chambers. Two solenoids control flow of pressurized air to lines connected to each bladder of the air bed.

U.S. Pat. No. 6,483,264 provides another example of an air pump for an air bed. Here, the pump has a motor operated impeller disposed in a sub-housing section of the pump unit. The impeller sends pressurized air through an internal passageway to another sub-housing containing two solenoids controlling air flow to the mattresses.

While both of these units are designed to be relatively compact and quiet as well as produce sufficient air flow volume and pressure for use in an air bed, they each have attributes that make them somewhat disadvantageous. The '756 device has a relatively complicated drive arrangement and requires an extra air chamber and transfer tube for one set of diaphragms, thus increasing its footprint as well as its component and assembly cost. The '264 device requires multiple individual housing sections that must be properly assembled and sealed to avoid leakage and allow the pump to operate efficiently, and the impeller and associated housing chamber necessitates a somewhat larger overall unit. Moreover, both devices have rotating motors that can wear and become noisy or decrease the operational life of the unit.

It would be beneficial, therefore, to provide an improved pump unit suitable for inflatable devices, such as air beds, having integral pump and valve assemblies in a housing of simplified construction.

SUMMARY OF THE INVENTION

The present invention provides an air pump unit having a pressure housing with an air inlet and air outlet. The housing contains a pump assembly and a solenoid valve assembly. The pump assembly has a reciprocating member disposed along a stroke axis for drawing air into the pressure housing through the air inlet to pressurize the housing. The valve assembly is disposed within the pressurized interior of the pressure housing and controls flow of the pressurized air through the air outlet.

The pump unit can have one or more, preferably three, vibration isolation mounts at an exterior of the pressure housing, preferably there are at least two isolation mounts located at opposite walls of the pressure housing along a line essentially parallel to the stroke axis. The isolation mounts are preferably made of a resilient material that dampens vibration arising from movement of the pump assembly. Holes through the isolation mounts further improve vibration dampening.

The pump assembly is preferably a linear diaphragm pump including an electromagnet, with two coils in parallel or one coil and one bracket, driving a permanent magnet shuttle (a magnetically inert shuttle with two permanent magnets molded therein) back and forth along the stroke axis. Opposite ends of the shuttle mount a pair of diaphragms which extend across diaphragm openings in opposite walls of the pressure housing. A pair of valve heads mounted over the diaphragm openings have umbrella type intake and exhaust valves controlling flow from two air inlets to a downstream side of each diaphragm and then to an interior of the pressure housing.

A cover enclosing an open side of the pressure housing includes a plurality of fittings for connecting air lines to the pressure housing. The cover also provides a mount for the valve assembly consisting of a partition wall dividing an interior of the pressure housing into two compartment and defining at least one air flow passageway between the compartments. The valve assembly preferably includes a plurality of solenoids for operating valves controlling flow through fittings.

In one preferred form the invention provides a compact air pump and valve package with a pressure housing with two filtered inlet ports and three fittings for connecting air lines to an interior of the pressure housing. A linear diaphragm pump assembly disposed in the pressure housing has a permanent magnetic shuttle reciprocated an electromagnet to drive a pair of diaphragms in a pair of valve heads. The valve heads have intake and exhaust valves controlling flow from the inlet ports in the pressure housing to downstream sides of the diaphragms and on to the pressure housing interior so as to draw in and pressurize air inside the pressure housing. The valve assembly has three solenoid valves disposed within the pressure housing. Each solenoid valve controls flow from the pressure housing through an associated fitting.

Thus, the present invention provides a compact pump unit in which a single housing contains both the pump and valve components. The entire interior of the housing becomes pressurized during operation of the pump such that no tubes or other conduit are necessary to transfer the pressurized air exhausted from the valve heads to the valve assembly. This compact package affords a number of benefits, particularly in easing assembly, reducing or eliminating certain seals, conduit and mounting components, and increasing reliability of the pump by reducing interconnections and thereby the occurrence of air leakage. The electro-magnetically controlled linear diaphragm pump operates quietly, with noise further reduced by the inlet filters. Vibration (and noise) is also reduced by the resilient isolation mounts at the exterior of the package.

These and still other advantages of the invention will be apparent from the detailed description and drawings. What follows is a description of a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
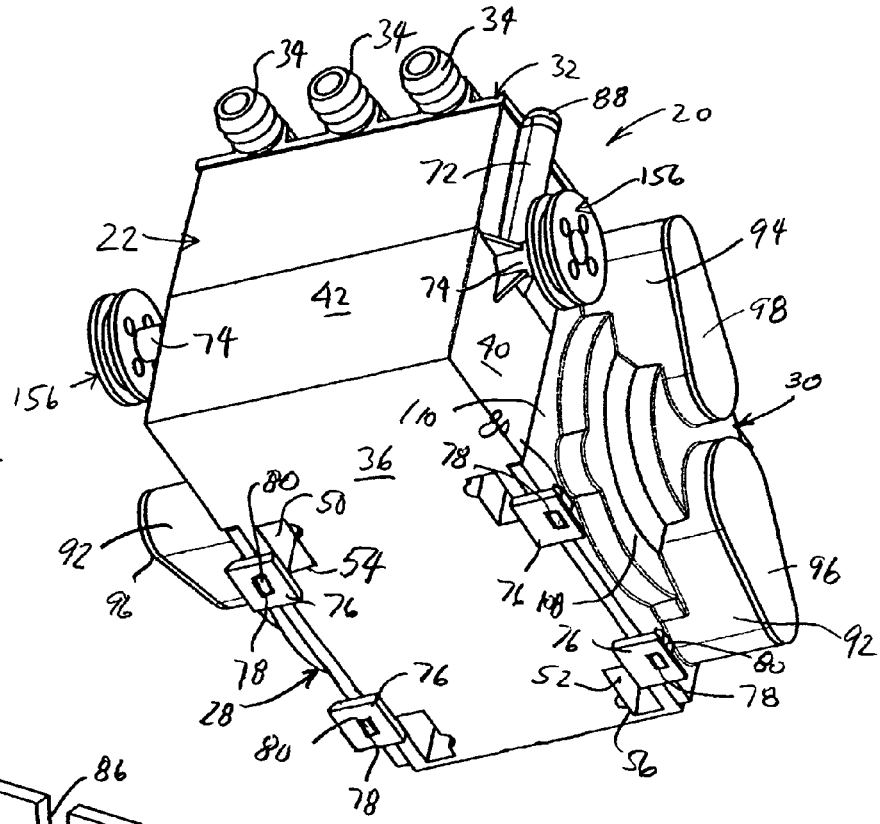
FIG. 1 is a perspective view of a compact air pump and valve unit according to the present invention.
Figure 8:
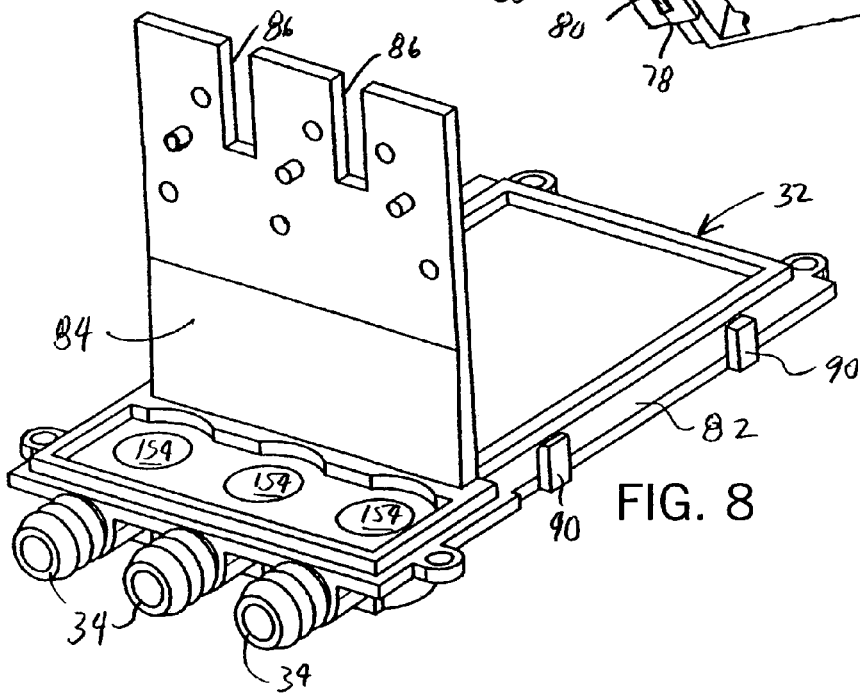
FIG. 8 is an inverted perspective view of the pressure housing cover.

A preferred version of the pump of the present invention will now be described in detail. Referring to FIGS. 1-8, a pump unit 20 generally includes a pressure housing 22 containing a solenoid valve assembly 24 and a linear pump assembly 26. Air flow to and from the pump assembly 26 pass through two valve heads 28 and 30 mounted to the pressure housing 22. The pressure housing 22 also includes a separate cover 32 having three hose barb type fittings 34 for connecting three air lines to the interior of the pressure housing 22 when opened by the solenoid valve assembly 24.

Figure 6:
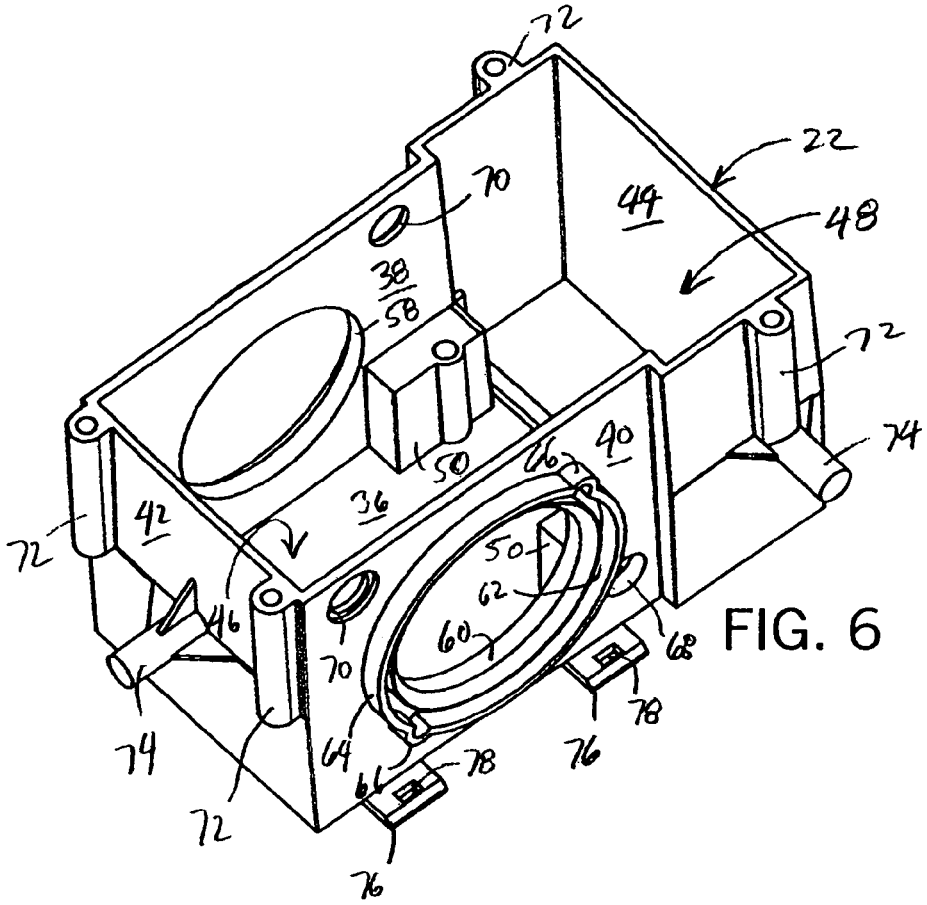
FIG. 6 is a perspective view of a pressure housing of the pump unit shown without its cover.
Figure 7:
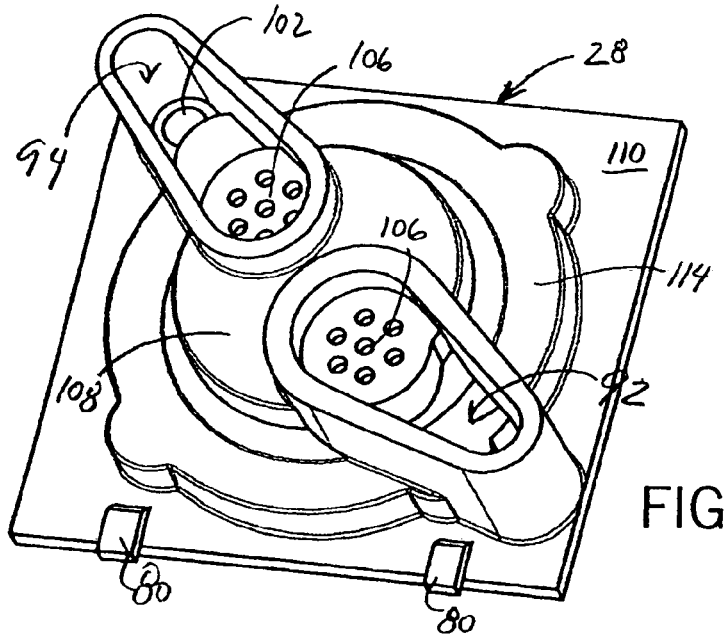
FIG. 7 is a perspective view of a valve head for the pump unit with its valve covers removed.

Referring to FIGS. 1 and 6, the pressure housing 22 is a box-like, preferably plastic, structure with a bottom wall 36, two upright side walls 38 and 40 and two upright ends walls 42 and 44. The upright walls define an open top side that is enclosed by the cover 32. The pressure housing 22 and its cover 32 create an enclosed interior having a piston chamber 46 and a valve chamber 48. The interior is designed to be pressurized during operation as a pump so that the internal pressure is greater than ambient pressure. Note, however, that the pressure housing may also be negatively pressurized, so that the internal pressure is less than ambient, if it is to be operated to draw a vacuum.

The bottom wall 36 and interior blocks 50 and 52 define two integral inlet passageways 54 and 56, respectfully, in which reside filter elements 57. The side walls 38 and 40 include respective diaphragm openings 58 and 60. Each diaphragm opening is ringed by a groove 62 (one shown) and a circular wall 64 (one shown) having two anti-rotation ears 66. Each of the side walls 38 and 40 also defines an intake port 68 (not shown in side wall 38) in communication with ambient air via the respective inlet passageways 54 and 56 and an exhaust port 70 in communication with the interior of the pressure housing 22. The exterior of the pressure housing 22 further has four threaded bore screw mounts 72 and three mounting posts 74, one extending from end wall 42 and two extending from the side walls 38 and 40. Four tabs 76, two extending out from each side wall 38 and 40, define small slots 78 for receiving tabs 80 on the valve heads 28 and 30.

As shown in FIGS. 2-5 and 8, the cover 32 is molded as one piece to define an upper wall 82 including the three fittings 34 and a partition wall 84 depending from the upper wall 82 at a right angle. The partition wall 84 provides a mounting location for the solenoid valve assembly 24 and also divides the interior between the piston 46 and valve 48 chambers. The partition wall 84, however, has two slots 86 which permit air communication between the two chambers 46 and 48 in addition gaps at its side edges. The cover 32 is sealed against the other walls of the pressure housing 22 by four fasteners 88 threaded into the screw mounts 72. Four tabs 90 extend down from side edges of the cover 32 to retain the top edges of the valve heads 28 and 30.

Referring to FIGS. 2-5 and 7, the valve heads 28 and 30 are identical and include an intake chamber 92 and a slightly smaller exhaust chamber 94 enclosed by respective valve covers 96 and 98 sonically welded to the valve heads 28 and 30. The intake 92 and exhaust 94 chambers have openings 100 and 102 in communication with the respective intake 68 and exhaust 70 ports of the pressure housing 22. Each exhaust opening 102 is actually a cylindrical passageway that protrudes through the exhaust port 70 and is sealed by an o-ring 104. Each of the intake 92 and exhaust 94 chambers have a cluster of small ports 106 leading from the respective intake 68 and exhaust 70 ports to a main valve head chamber 108 recessed back from a base plate 110 of the valve heads 28 and 30. Two umbrella valves 112 control flow through these ports 106 with the intake valve having its head in the valve head chamber 108 and the exhaust valve having its head in the exhaust chamber 94. The valve heads 28 and 30 have a circular recess 114 with two pockets 116 that fit over the ears 66 of the pressure housing 22.

The valve heads 28 and 30 cover respective diaphragm assemblies 118 and 120 of the pump assembly 26. The diaphragm assemblies 118 and 120 are identical and as shown in FIGS. 2 and 10-12 they each include a support ring 122 supporting a flexible diaphragm 124 sandwiched between central front 126 and rear 128 retainers (which are preferably sonically welded together) and two Teflon® rings 130. The support ring 122 has ears 132 that nest within the ears 66 of the pressure housing 22 and capture mating ears of the diaphragm 124. The support ring 122 is secured against the pressure housing 22 by the associated valve head to essentially fix the outer periphery of the diaphragm 124. Each set of retainers 126 and 128 have central bores that receive a threaded fastener (not shown) threaded into a tapped bore 134 at each end of a reciprocating shuttle 136 component of the pump assembly 26 thereby moving the center of each diaphragm 124 in response to movement of the shuttle 136.

Referring to FIGS. 2, 10, 13 and 14, the shuttle 136 is a generally rectangular structure of magnetically inert material, such as a thermoplastic, having two rectilinear permanent magnets 138, such as non-magnetized neodymium magnets, located and retained by a pin and boss arrangement in two rectangular openings symmetrical about the vertical and horizontal centerlines of the shuttle 136 with their north poles at opposite faces of the shuttle 136. The shuttle is reciprocated along a stroke axis 140 (concentric with the diaphragm assembles) by magnetic flux created by a pair of identical electromagnetic coils 142, suitable coupled to a power source and control unit as known in the art. The electromagnetic coils 12 are wound on a bobbin disposed on an E-shaped core, as is conventional. Supplying the coils with alternating signals 180 degrees out of phase will supply two sets of magnetic flux lines that drive the shuttle 136 back and forth along the stroke axis 140 to generate the 180 degrees out of phase pumping action of the two diaphragms 124, as known in the art. Note that the present invention could be practiced using a single electromagnetic coil and suitable bracketry.

Figure 2:
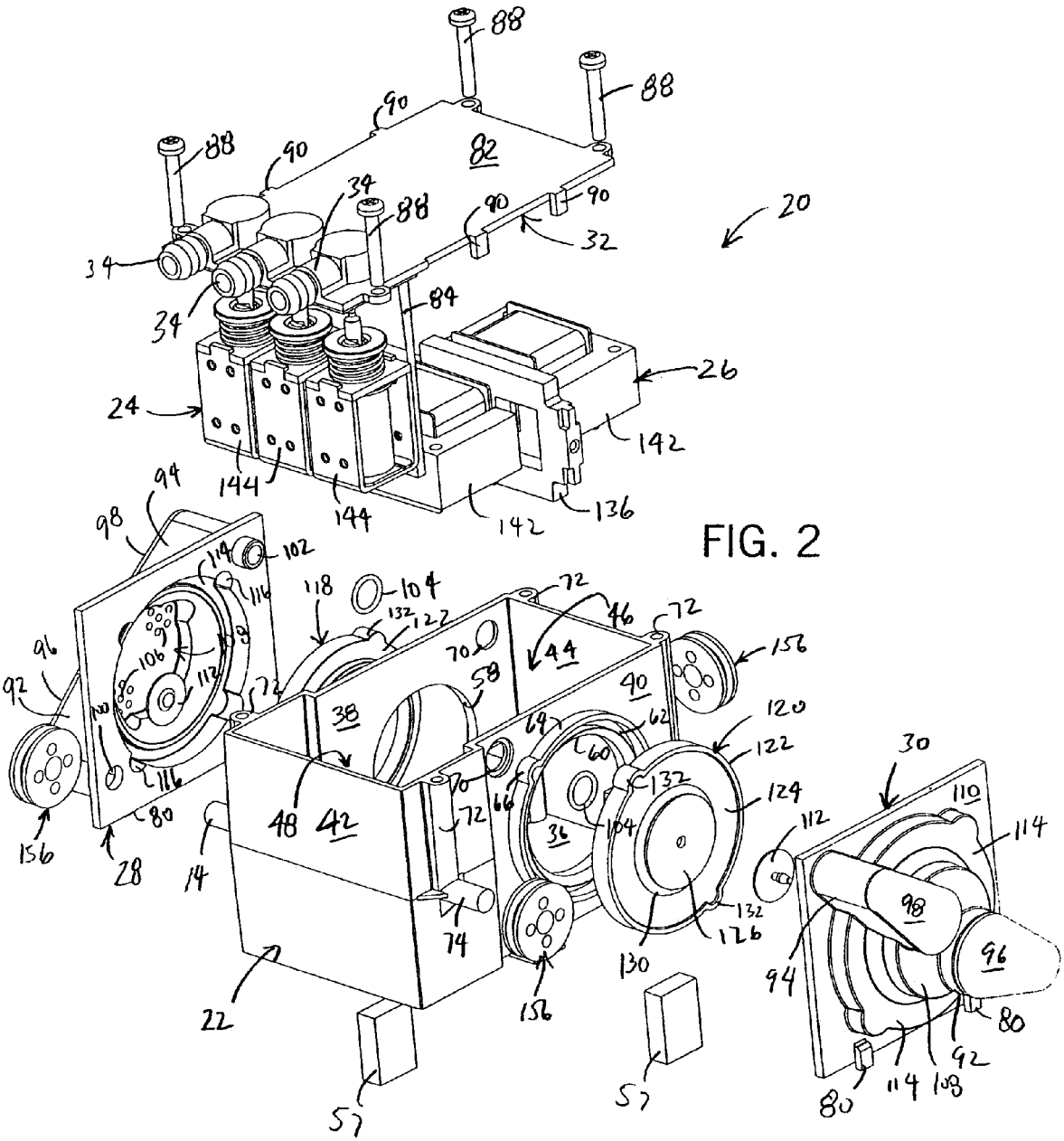
FIG. 2 is an exploded perspective view thereof.
Figure 15:
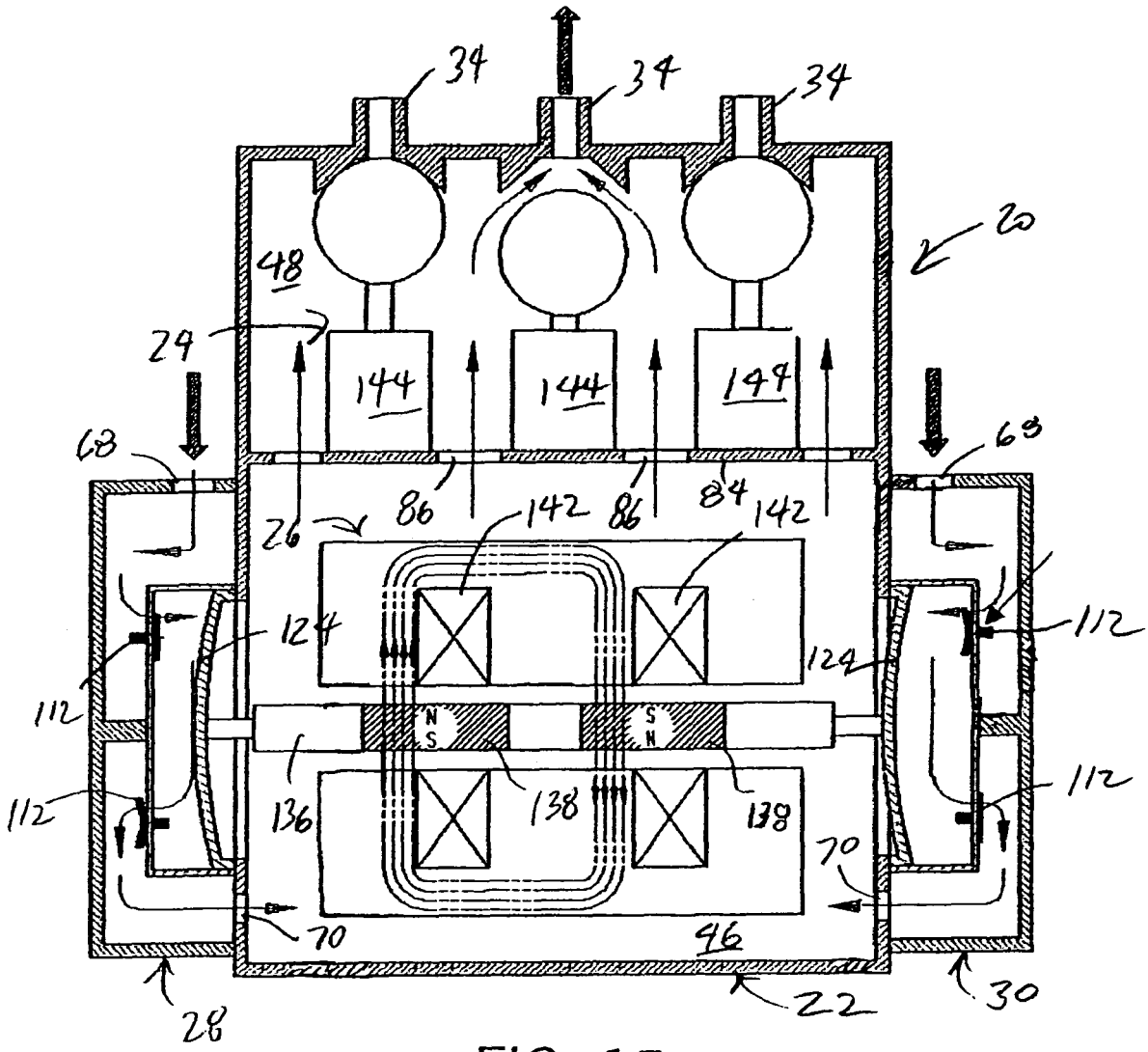
FIG. 15 is a diagrammatic view of the pump unit showing the shuttle in one extreme position and a middle solenoid valve open.

In particular, referring to FIGS. 2 and 15, reciprocation of the shuttle 136 and diaphragms 124 draws external ambient air into the pressure housing 22 through one of the inlets 54 and 56 and into the associated valve head intake chamber 92 after passing through the associated intake port 68 and inlet opening 100. Air in this valve head continues through the cluster of small ports 106 into the valve chamber 108 after the valve 112 opens by virtue of the suction created by the diaphragm. While this diaphragm is in the suction stroke, the other diaphragm is in the compression stroke driving the air in its valve chamber out of the cluster of openings into its exhaust chamber 94 with the associated valve opening under the force of compression. Air from the exhaust chamber is forced through the associated opening 102 and port 70 and into the interior of the pressure housing 22. This pattern continues in alternating fashion through both valve heads 28 and 30 to increase the pressure inside the pressure housing 22. An additional benefit of routing the air in this manner is that the compressed (higher density) air flows directly past the electromagnet coils, convectively cooling them and dissipating heat from inside the pressure housing 22.

Figure 9:
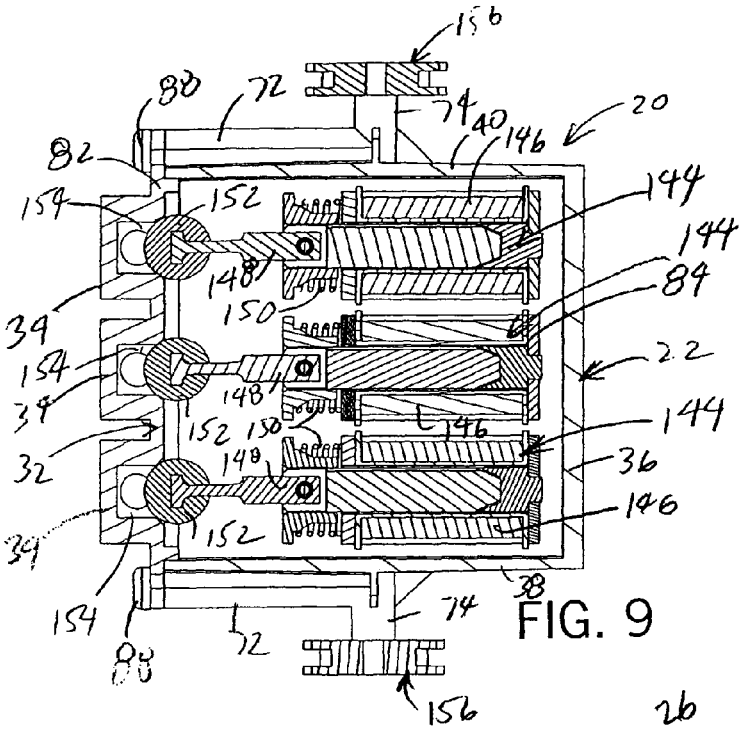
FIG. 9 is a cross-sectional view taken along line 9-9 of FIG. 3 showing the three solenoids of a valve assembly.
Figure 10:
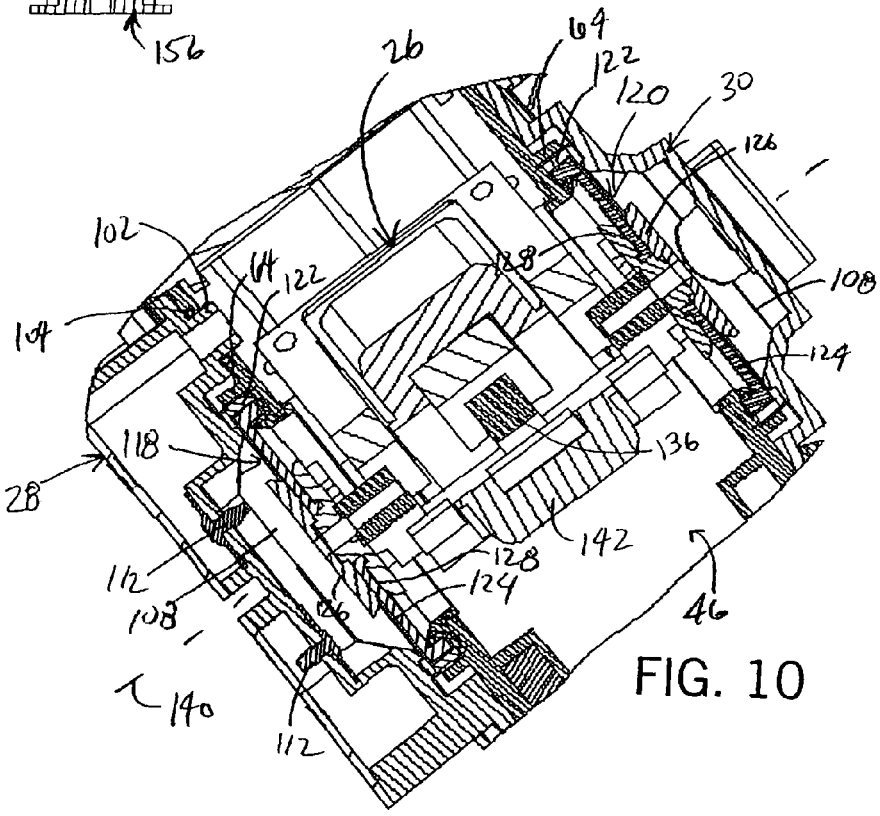
FIG. 10 is a cross-sectional view taken along line 10-10 of FIG. 5 showing a linear pump assembly.
Figure 11:
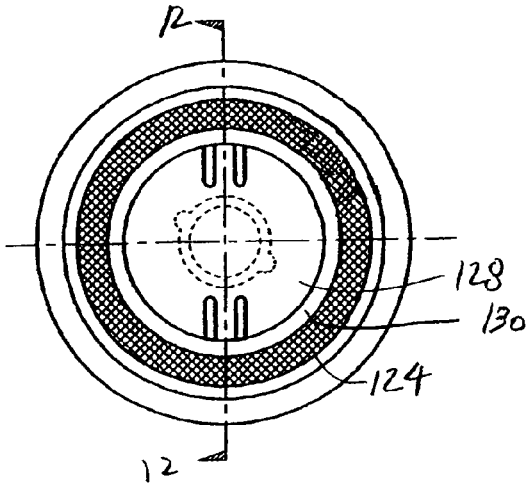
FIG. 11 is a back side view of one of the diaphragm assemblies included in the pump assembly.
Figure 12:
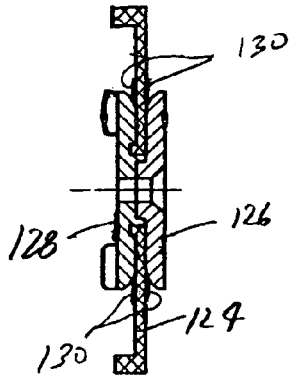
FIG. 12 is a cross-sectional view taken along line 12-12 of FIG. 11.
Figure 13:
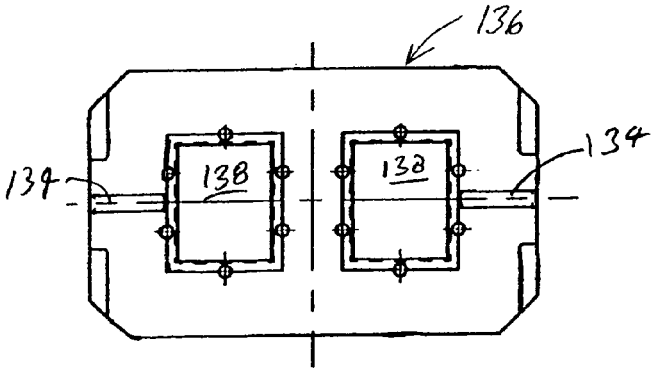
FIG. 13 is a side view of the permanent magnet shuttle.
Figure 14:
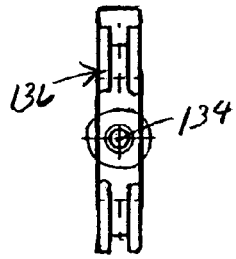
FIG. 14 is an end view thereof.

Outlet flow of the pressurized air from inside the pressure housing 22 is controlled by the solenoid valve assembly 24. As shown in FIGS. 2, 9 and 15, the valve assembly 24 includes three identical solenoid valves 144 mounted inside the pressure housing 22 to the partition wall 84 of the cover 32. The solenoids 144 are of conventional construction, having an inductive coil 146 moving a metallic plunger 148 against a spring 150 to unseat a ball end 152 from one of three openings 154 of the passageways through the three fittings 34. When the solenoids 144 are de-energized the springs 150 return the plungers 148 and balls 152 to their initial positions to close off (and keep closed) the openings 154. The solenoids 144 are electrically coupled to power and one or more controls so that each is independently operable. As shown in FIG. 15, the pressurized air inside the pressure housing 22 is in communication with the valve assembly chamber 48 via the passageways through and around the partition 84 so that no tubes or other conduit necessary.

Figure 3:
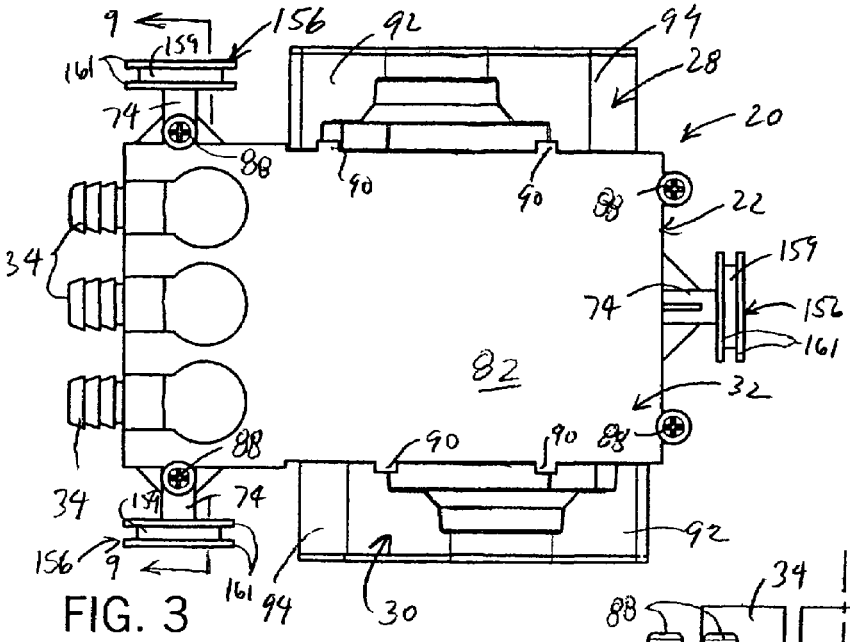
FIG. 3 is a top view thereof.
Figure 4:
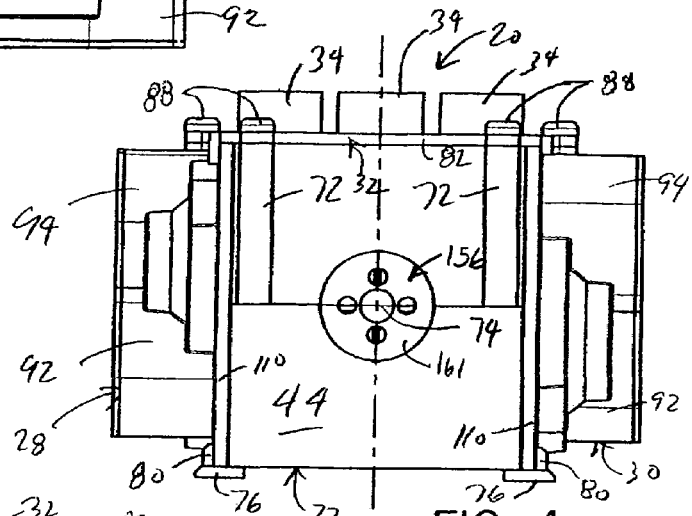
FIG. 4 is an end view thereof.
Figure 5:
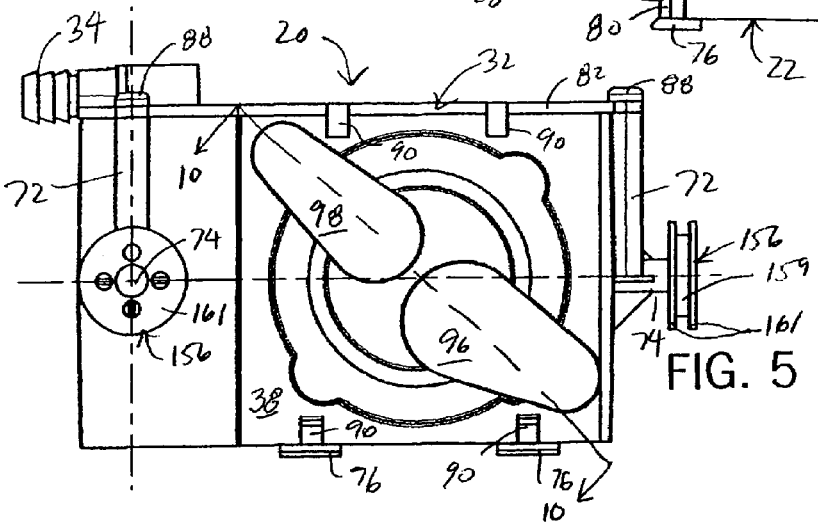
FIG. 5 is a side view thereof.

The pump unit of the above construction is thus suitable for use as an air pump for an air bed. It is compact so that it can be mounted to a frame of the air bed. Referring to FIGS. 1 and 3, the pump unit is preferably mounted to special receptors (not shown) for vibration isolating mounts 156. These mounts 158 are made of a resilient vibration damping material, such as rubber, or more preferably neoprene, and have holes therethrough to further improve vibration dampening. The mounts 156 have a hole through the center so that they can be pressed onto the mounting posts 74 at the exterior of the pressure housing 22. It should be noted that two of the mounting posts 74 are collinear with a line parallel to the stroke axis 140 to better absorb the vibration arising from reciprocation of the shuttle 136. The mounts 156 have a peripheral groove that is used for locating and mounting them to the supporting structure (not shown).

Figure 16:
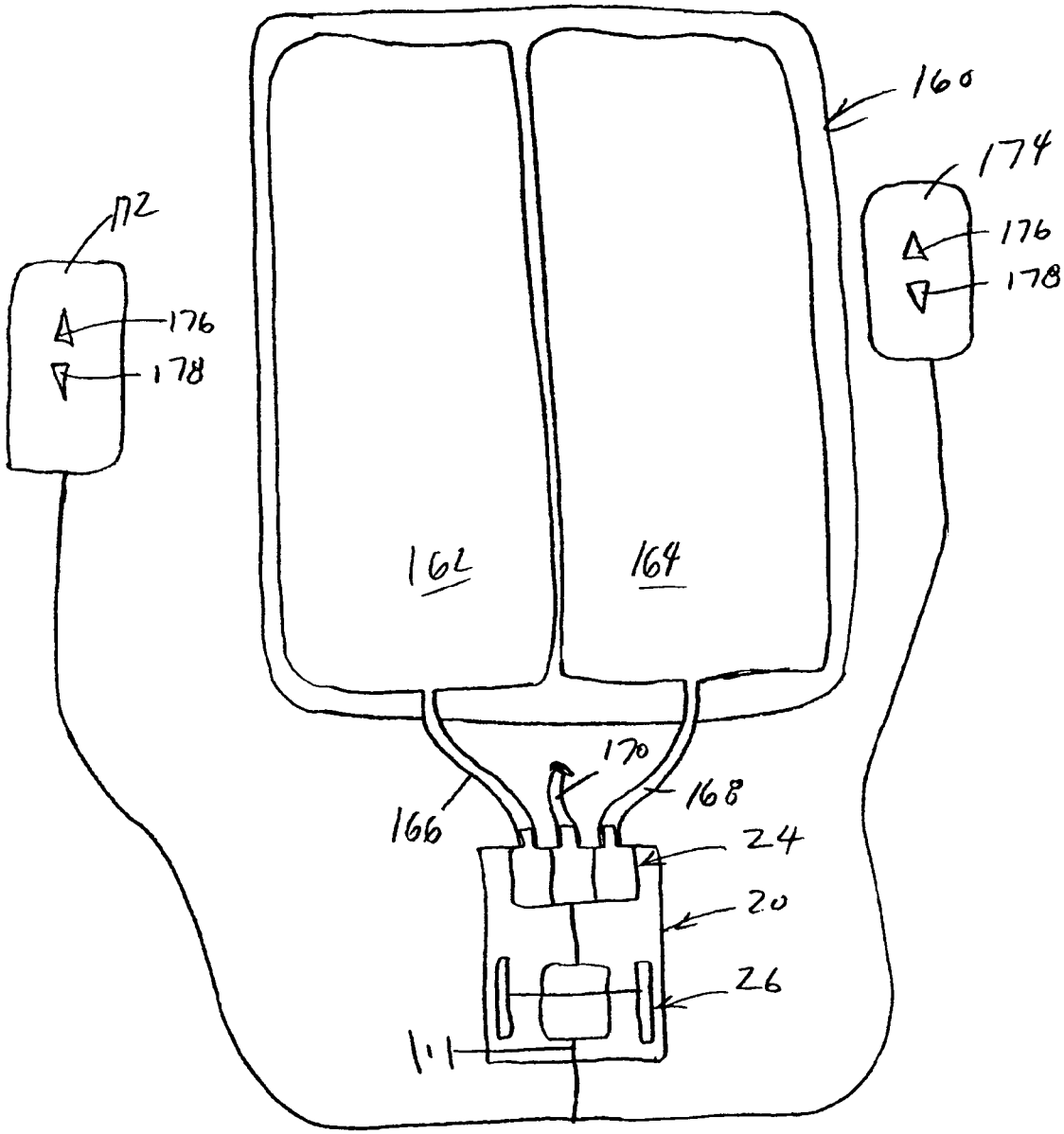
FIG. 16 is a schematic representation of the pump unit as a part of an air bed system having two air mattresses with two mattress inflation/deflation controls.

FIG. 16 shows a diagrammatic representation of the pump unit in as used in a preferred air bed application. The air bed 160 includes two mattress bladders 162 and 164 with respective air lines 166 and 168 running to two of the fittings 34 of the pump unit. A vent air line 170 having a muffler at one end is connected to the third fitting 34. Two controllers 172 and 174 are connected to the pump unit which is plugged into a standard electrical socket.

The air bed operates as follows. Depressing an up arrow 176 on either of the controllers will energize the associated solenoid to move the ball end away from the associated opening, thereby allowing pressurized air from the interior of the pressure housing to escape into the associated air line and air mattress. Depressing the up arrow also sends a signal to the electromagnetic coils to commence reciprocation of the shuttle and diaphragms to pressurize, or maintain the pressure inside, the pressure housing. Depressing the up arrow of the other control operates the pump assembly and its associated solenoid in the same manner to inflate the other air mattress. Depressing either of the down arrows 178 on the controls energizes the third solenoid in combination with the solenoid controlling the associated air line to vent the associated air mattress and the pressure housing to ambient through the vent air line 170. Depressing the down arrows does not initiate pumping.

The present invention thus provides a compact pump unit in which a single housing contains both the pump and valve components. The entire interior of the housing becomes pressurized during operation of the pump such that no tubes or other conduit are necessary to transfer the pressurized air exhausted from the valve heads to the valve assembly. This compact package affords a number of benefits, particularly in easing assembly, reducing or eliminating certain seals, conduit and mounting components, and increasing reliability of the pump by reducing interconnections and thereby the occurrence of air leakage. The electro-magnetically controlled linear diaphragm pump operates quietly, with noise further reduced by the inlet filters. Vibration (and noise) is also reduced by the resilient isolation mounts at the exterior of the package.

It should be appreciated that merely a preferred embodiment of the invention has been described above. However, many modifications and variations to the preferred embodiment will be apparent to those skilled in the art, which will be within the spirit and scope of the invention. For example, while the a preferred air bed application has been described, the air package of the present invention is suitable for use in other applications. Therefore, the invention should not be limited to the described embodiment. To ascertain the full scope of the invention, the following claims should be referenced.

What is claimed is:

1. An air pump unit, comprising:

a pressure housing having a single chamber pressurized interior, an air inlet and air outlet;

a pump assembly disposed in the single chamber pressurized interior of the pressure housing having a reciprocating member disposed along a stroke axis for drawing air into the pressure housing through the air inlet; and a solenoid valve assembly disposed within the single chamber pressurized interior of the pressure housing controlling flow of the pressurized air in the pressure housing through the air outlet, wherein said air flowing through said air outlet exits said pressurized interior without passing through an additional housing.

2. The pump unit of claim 1, wherein said solenoid valve assembly and said reciprocating member are in fluid communication with one another with a partition therebetween, said solenoid valves mounted on said partition, said partition adapted to allow the flow of said air across said partition without valves being mounted on said partition, said partition in said single chamber pressurized interior.

3. The pump unit of claim 1, wherein the reciprocating member is a permanent magnet shuttle and wherein the pump assembly further includes an electromagnet driving the shuttle along the stroke axis.

4. The pump unit of claim 3, wherein the electromagnet includes two wire coils electrically coupled in parallel.

5. The pump unit of claim 3, wherein the pump assembly further includes a pair of diaphragms mounted to opposite ends of the shuttle across diaphragm openings in opposite walls of the pressure housing.

6. The pump unit of claim 5, further including a pair of valve heads mounted over the diaphragm openings including intake and exhaust valves controlling flow from the air inlet to a downstream side of each diaphragm and from the downstream side of each diaphragm to the interior of the pressure housing.

7. The pump unit of claim 6, wherein the valve heads mount to the pressure housing by retention tabs.

8. The pump unit of claim 6, wherein there are two air inlets controlled by intake valves of the valve heads.

9. The pump unit of claim 8, wherein the air inlets are cavities formed in a side of the pressure housing.

10. The pump unit of claim 9, wherein the cavities contain filter elements.

11. The pump unit of claim 1, wherein the pressure housing includes a cover mounted to an open side thereof.

12. The pump unit of claim 11, wherein the cover includes a fitting for an air line in communication with the air outlet.

13. The pump unit of claim 1, wherein the valve assembly includes a second solenoid valve controlling flow through a second air outlet in communication with the interior of the pressure housing.

14. An air pump unit, comprising:

a pressure housing having a pressurized interior, an air inlet and air outlet;

a pump assembly disposed in the pressurized interior of the pressure housing, said assembly having a reciprocating member disposed along a stroke axis for drawing air into the pressure housing through the air inlet; and a solenoid valve assembly disposed within the pressurized interior of the pressure housing controlling flow of the pressurized air in the pressure housing through the air outlet;

two vibration isolation mounts made of resilient material are located at opposite walls of the pressure housing along a line essentially parallel to the stroke axis.

15. An air pump unit, comprising:

a pressure housing having a pressurized interior, an air inlet and air outlet;

a pump assembly disposed in the pressurized interior of the pressure housing, said assembly having a reciprocating member disposed along a stroke axis for drawing air into the pressure housing through the air inlet; and a solenoid valve assembly disposed within the pressurized interior of the pressure housing controlling flow of the pressurized air in the pressure housing through the air outlet;

wherein the pressure housing includes a cover mounted to an open side thereof;

the cover includes a fitting for an air line in communication with the air outlet; and wherein the cover includes a mount for the solenoid valve assembly.

16. The pump unit of claim 15, wherein the mount is a partition wall dividing the interior of the pressure housing into two compartments containing the piston assembly and the valve assembly and defining at least one air flow passageway between the compartments.

17. An air pump unit, comprising:

a pressure housing having a pressurized interior, an air inlet and air outlet;

a pump assembly disposed in the pressurized interior of the pressure housing having a reciprocating member disposed along a stroke axis for drawing air into the pressure housing through the air inlet; and a solenoid valve assembly disposed within the pressurized interior of the pressure housing controlling flow of the pressurized air in the pressure housing through the air outlet;

wherein the solenoid valve assembly includes a second solenoid valve controlling flow through a second air outlet in communication with the interior of the pressure housing;

wherein the solenoid valve assembly includes a third solenoid valve controlling flow through a vent outlet.

18. A compact air pump and valve package, comprising:

a pressure housing defining two inlet ports and a plurality of fittings for connecting air lines to an interior of the pressure housing;

a linear diaphragm pump assembly disposed in the pressure housing having a permanent magnetic shuttle reciprocated along a stroke axis by an electromagnet, the shuttle mounting at opposite ends a pair of diaphragms across diaphragm openings in opposite walls of the pressure housing enclosed by a pair of valve heads having intake and exhaust valves controlling flow from the inlet ports in the pressure housing to downstream sides of the diaphragms and to the pressure housing interior so as to draw in and pressurize air inside the pressure housing; and a valve assembly having a plurality of solenoid valves disposed within the pressurized interior of the pressure housing, each solenoid valve being operable to control flow from the pressure housing through an associated one of the plurality of fittings;

wherein there are three fittings and three solenoid valves each independently controlling flow through one of the fittings, wherein two fittings are coupled to separate air bladders and one fitting is coupled to ambient pressure, wherein opening one of the solenoid valves controlling flow to one of the fittings coupled to one of the air bladders and opening the solenoid valve controlling flow to the fitting coupled to ambient pressure vents the pressure in the interior of the pressure housing to deflate the associated air bladder.

* * * * *